US006273291B1

(12) United States Patent
Conti

(10) Patent No.: US 6,273,291 B1
(45) Date of Patent: Aug. 14, 2001

(54) PLASTIC CONTAINERS FOR QUICK FREEZING OF FRUIT

(75) Inventor: Rino Conti, Stoughton, MA (US)

(73) Assignee: Plastican, Inc., Leominster, MA (US)

( * ) Notice: Subject to any disclaimer, the term of this patent is extended or adjusted under 35 U.S.C. 154(b) by 0 days.

(21) Appl. No.: 09/565,073

(22) Filed: May 5, 2000

Related U.S. Application Data

(63) Continuation-in-part of application No. 29/109,829, filed on Aug. 23, 1999, and a continuation-in-part of application No. 29/109,846, filed on Aug. 23, 1999.

(51) Int. Cl.[7] ..... B65D 43/03

(52) U.S. Cl. ..... 220/781; 220/789; 220/760; 220/790; 220/770; 220/23.86; 206/503; 206/508

(58) Field of Search ..... 220/760, 780, 220/781, 789, 790, 606, 380, 604, 376, 23.86, 23.83; 206/508, 511, 503, 512, 769, 770

(56) References Cited

U.S. PATENT DOCUMENTS

D. 380,385 * 7/1997 Litke ..... 220/376 X
1,688,992 * 10/1928 Smith ..... 220/23.86
2,210,283 * 8/1940 Cowan ..... 220/23.86 X
2,780,551 * 2/1957 Guadagni .
3,061,139 * 10/1962 Edwards .
3,112,841 * 12/1963 Martinelli .
3,362,565 * 1/1968 McCormick ..... 220/781 X
3,377,172 * 4/1968 Benson et al. .
3,651,981 * 3/1972 Kinney .
3,743,133 * 7/1973 Rathbun ..... 220/380
3,773,207 * 11/1973 Dokoupil et al. ..... 220/380 X
3,964,635 * 6/1976 Ludder .
4,202,462 * 5/1980 Imber .
4,372,526 * 2/1983 Daenen et al. .
4,489,849 * 12/1984 Blanchette .
4,844,263 * 7/1989 Hadtke ..... 206/511 X
5,150,804 * 9/1992 Blanchet et al. ..... 206/512 X
5,344,041 * 9/1994 Luburic et al. ..... 220/770 X
5,457,850 * 10/1995 Knox ..... 220/760
5,515,990 * 5/1996 Popeil et al. ..... 220/23.86
5,526,954 * 6/1996 Georgiadis ..... 220/760
5,816,439 * 10/1998 Lovell et al. ..... 220/760
5,873,482 * 2/1999 Conti .
6,047,850 * 4/2000 Matthews ..... 220/760

* cited by examiner

*Primary Examiner*—Allan N. Shoap
*Assistant Examiner*—Robin A Hylton
(74) *Attorney, Agent, or Firm*—Pandiscio & Pandiscio

(57) ABSTRACT

Containers with replaceable lids are provided for holding fresh fruit or other food that is to be quick frozen. The containers and lids are designed so that the containers may be stacked one upon the other and so that flow passages are provided between the lid of one container and the bottom of a like container resting on that lid to permit flow therebetween of a gaseous freezing medium such as frigid air.

8 Claims, 7 Drawing Sheets

PLASTIC CONTAINERS FOR QUICK FREEZING OF FRUIT

This is a continuation-in-part of my copending U.S. patent application Ser. No. 29/109,829 filed Aug. 23, 1999 for Container Lid and Ser. No. 29/109,846, filed Aug. 23, 1999 for Plastic Pail.

This invention relates to plastic containers with removable lids for use in quick freezing of fruit or other foods.

BACKGROUND OF THE INVENTION

Consumer tend to prefer frozen foods over canned foods for a number of reasons. Frozen foods tend to look better than canned foods. Also the canning process tends to produce greater changes in texture, appearance and taste than quick freezing.

In the conventional preparation of frozen fruit, after undergoing a washing operation, the fruit is placed in containers, after which the containers are sealed by application of removable lids and then subjected to a quick freezing operation. Fresh fruit are quick frozen in the dry state, or the fruit may be covered with a suitable syrup containing sucrose or some other sugar product. Examples of prior art methods for producing frozen fruit or other foods are provided by U.S. Pat. Nos. 2,780,551 issued Feb. 5, 1957 to D. G. Guadagni et al. and U.S. Pat. No. 3,377,172 issued Apr. 9, 1968 to E. J. Bensen et al. In a large scale operation a number of containers are subjected to quick freezing simultaneously. To maximize throughput in the quick freezing stage, it is desirable to stack containers one upon the other. However, a critical factor in freezing fruit in containers is to produce an even and complete freezing of the fruit, and stacking containers one upon the other tends interferes with the flow of frigid air or other gaseous freezing medium around the containers.

OBJECTS AND SUMMARY OF THE INVENTION

The primary object of this invention is to provide improved containers with replaceable lids for holding fresh fruit or other food that is to be quick frozen, the containers and lids being designed so that when the containers are stacked one upon the other, flow passages are provided between the containers for flow of a gaseous freezing medium such as frigid air.

The foregoing object is achieved by providing (1) a plurality of like containers each having projections or feet at its bottom end and (2) a plurality of lids for the containers, each lid being characterized by a rim portion having means for making a releasable connection with the top end of one of the containers, and a depressed center portion that coacts with the rim portion to define a contoured shallow nest for receiving the bottom end of a container that is placed on top of the lid, so that when two or more containers are stacked one on top of the other, (a) the bottom of a higher container is restrained against lateral movement by the lid of the next lower container, and (b) a gaseous freezing medium can flow between the stacked containers via passages that extend between the rim portion of the lid of the next lower container and the bottom of the higher container and also between the feet on the bottom of the higher container.

THE DRAWINGS

Figure 10:
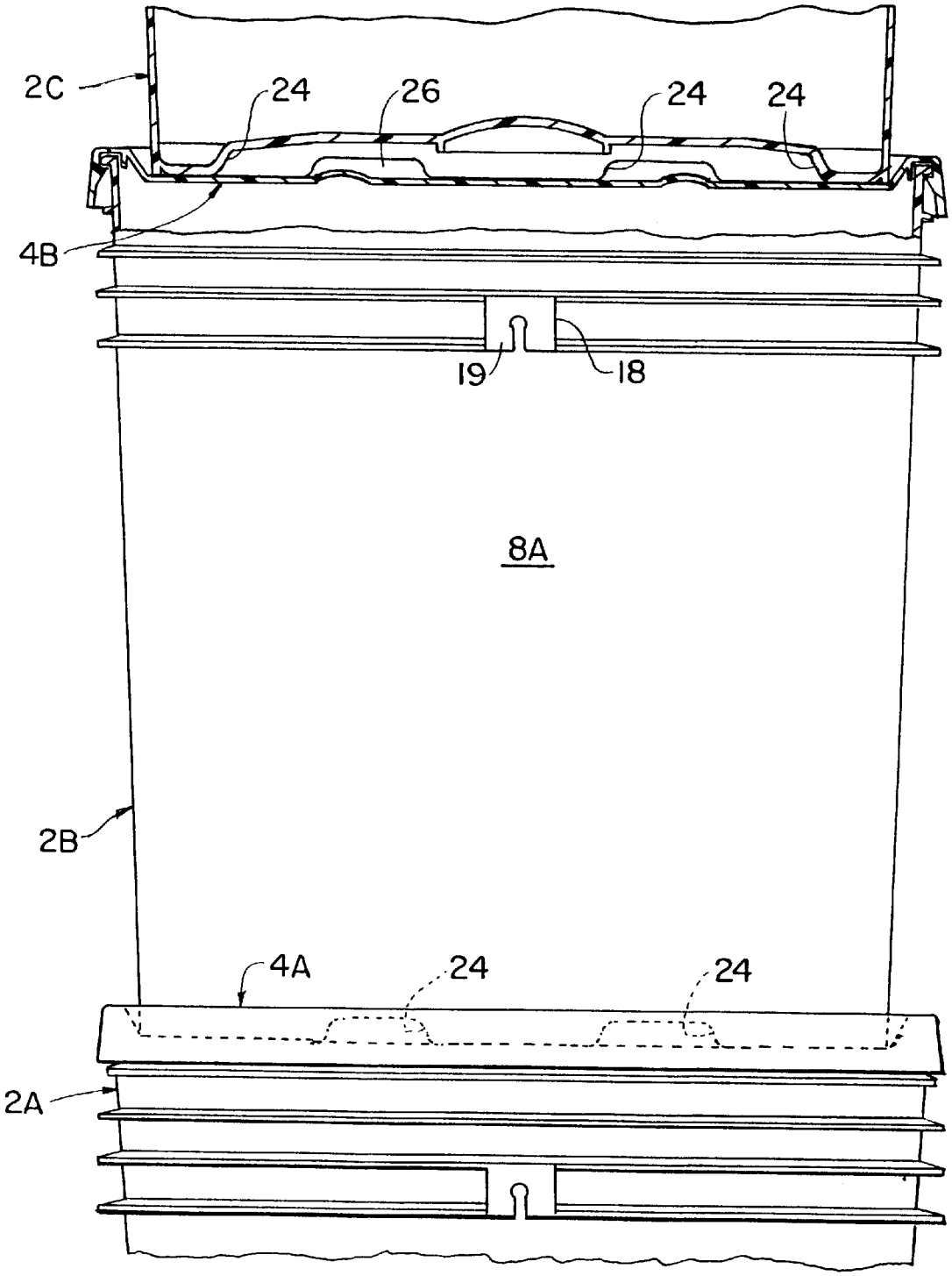

FIG. 10 a side elevation, partly in section, showing how the containers are disposed when stacked one upon the other.

In the drawings, like parts are designated by like numerals.

SPECIFIC DESCRIPTION OF THE INVENTION

Turning first to FIGS. 1–5, there is shown a container 2 and a lid 4 which is adapted to make a snap fit connection on the top end of the container. The container and lid are both made of plastic by injecting molding. By way of example but not limitation, they may be made of polyethylene or propylene.

Figure 4:
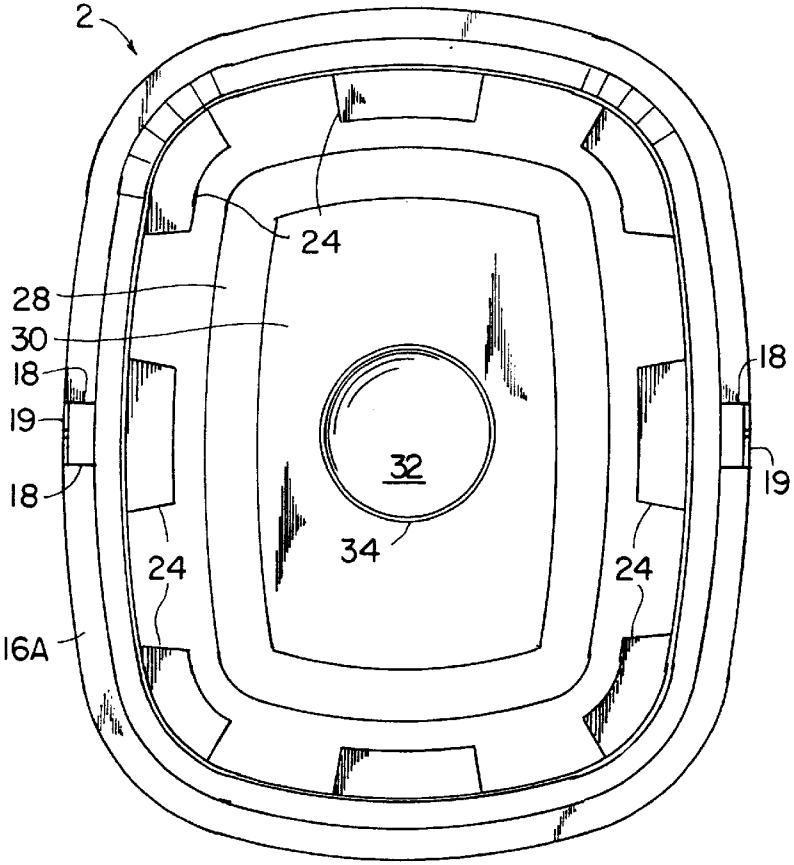
FIGS. 3 and 4 are plan and bottom views of the same container.
Figure 3:
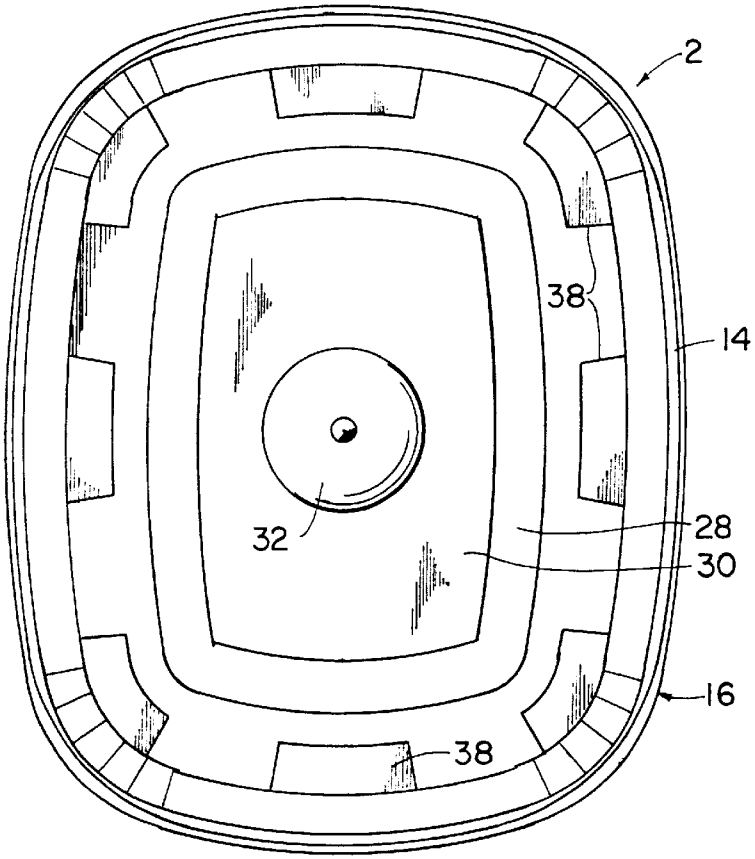

The container 2 comprises two relatively wide side walls 8A and 8B and two relatively narrow side walls 10A and 10B, plus a bottom wall identified generally at 12 (FIGS. 3, 4). Preferably the side walls 10A and 10B meet the relatively wide side walls 8A and 8B in a rounded corner configuration so that, as seen in FIGS. 3 and 4, the cross-sectional shape of the container is almost oval. The side walls 8A, 8B and 10A, 10B may be shaped so as to form a straight-sided container. However, it is preferred to have those walls slanted so as to form a tapered container as shown. The container has an external peripheral flange or lip 14 formed at its top end for interlocking engagement with the lid 4. Additionally, one or more external ribs 16 may be provided adjacent the top end of the container for aesthetic reasons and also to offer resistance to buckling of the side walls and facilitate gripping the container when it is desired to lift it.

Preferably the container is designed to be used as a pail or bucket, in which case two opposite side walls of the container are provided with means for pivotally securing a handle. In the illustrated embodiment of the invention this is achieved by interrupting the bottommost rib 16A at each of the side walls 8A, 8B and forming a pair of struts 18 integral with those side walls and also a short auxiliary side wall 19 that extends between struts 18 parallel to and spaced from side walls 8A, 8B. Struts 18 and short side wall 19 extend to and are formed integral with the second bottommost rib 16B where it is interrupted. As a result, at each of the side walls 8A, 8B, the struts 18 and side wall 19 form a handle support that defines an inverted U-shaped pocket open at its lower end to accommodate the hooked end of the U-shaped wire bail portion of a handle (not shown) for use in carrying the container and its contents. Each of the short side walls 19 is formed with a keyhole-shaped slot 20 for receiving and pivotally retaining the hooked end of the wire bail portion of the handle. Providing a plastic container with means for pivotally securing a handle is well known, as demonstrated by U.S. Pat. No. 5,873,482, issued Feb. 23, 1999 to Rino Conti for a Tamper-Evident Container Closure. An alternative bail support construction that may be used in practicing the present invention is disclosed in U.S. Pat. No. 4,489,849, issued Dec. 25, 1984 to H. J. Blanchette for Pivot Assembly.

Figures 1, 2:
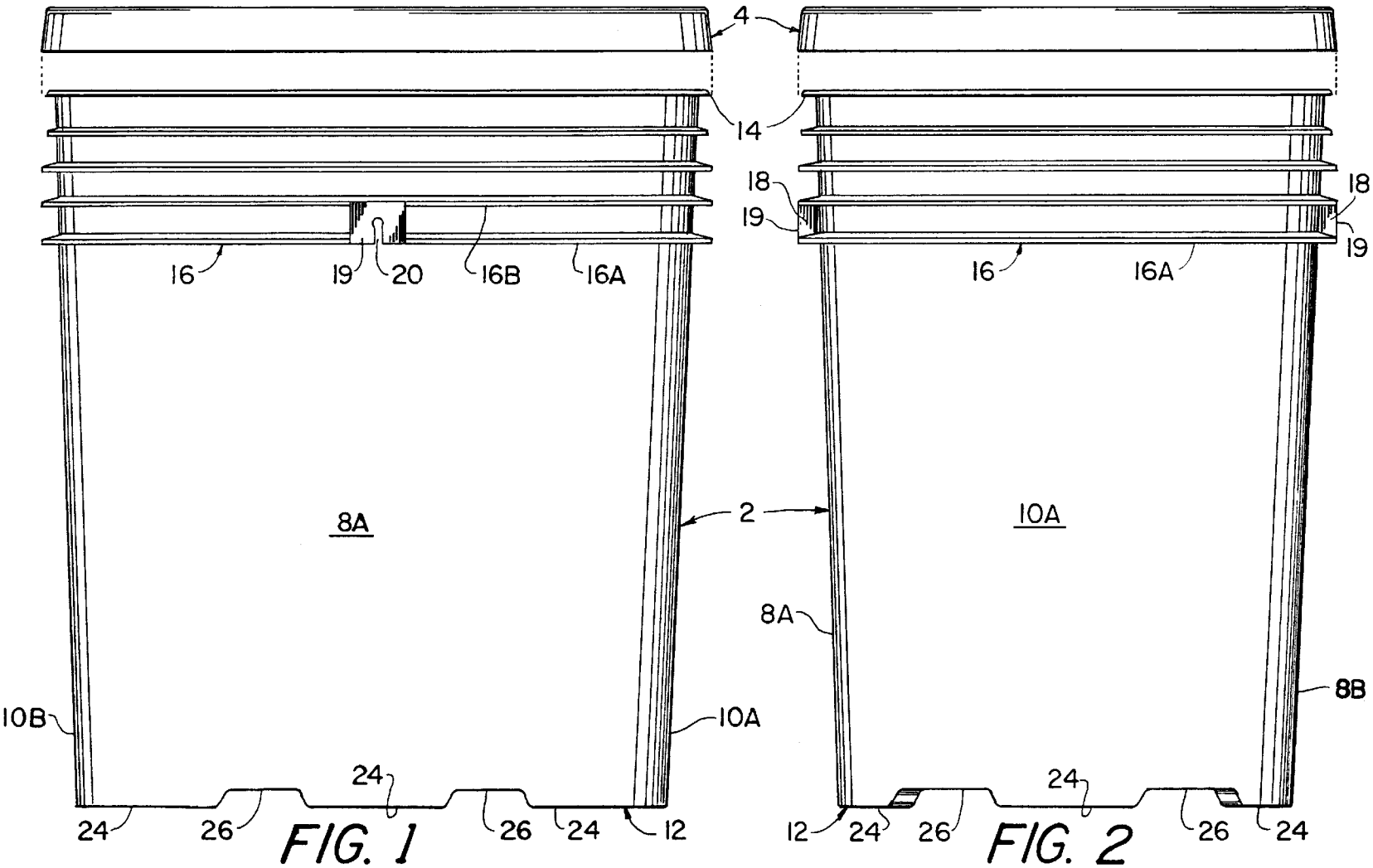
FIG. 1 is an exploded side view in elevation of a container and lid incorporating the present invention.
FIG. 2 is like FIG. 1 but with the container and lid rotated 90 degrees from the position of FIG. 1.

However, the bail support construction shown in FIGS. 1, 2 and 4 hereof is preferred over the Blanchette construction.

Figure 5:
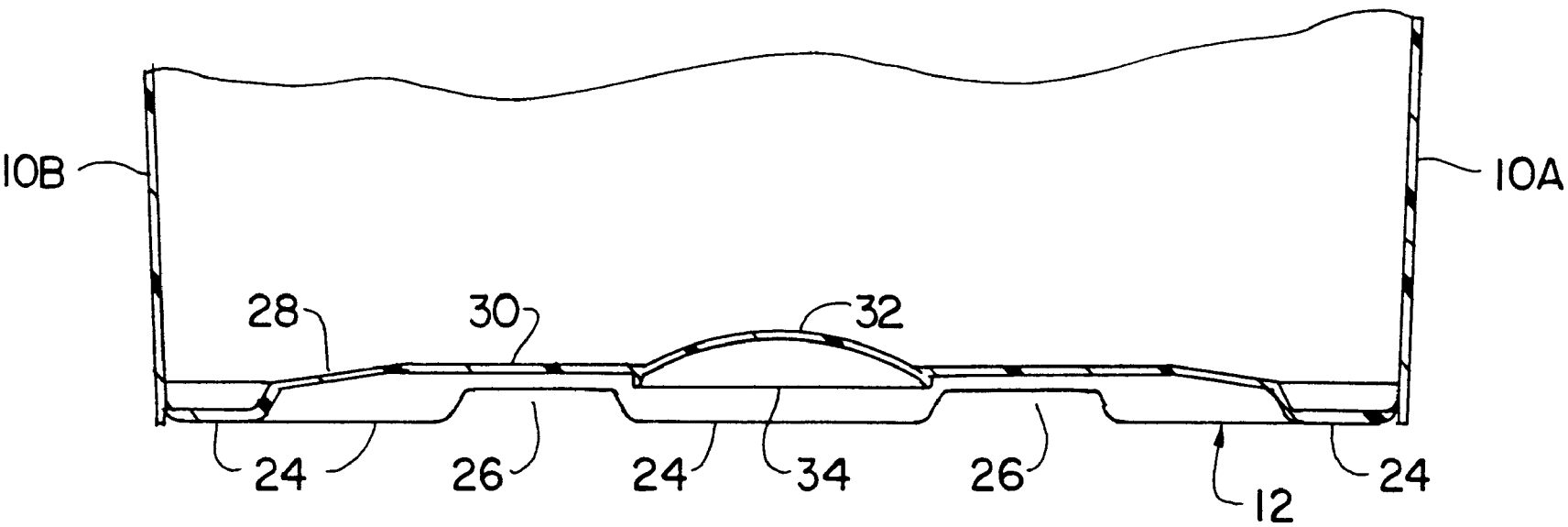
FIG. 5 is a fragmentary cross-sectional view of the bottom end of the container.
Figure 7:
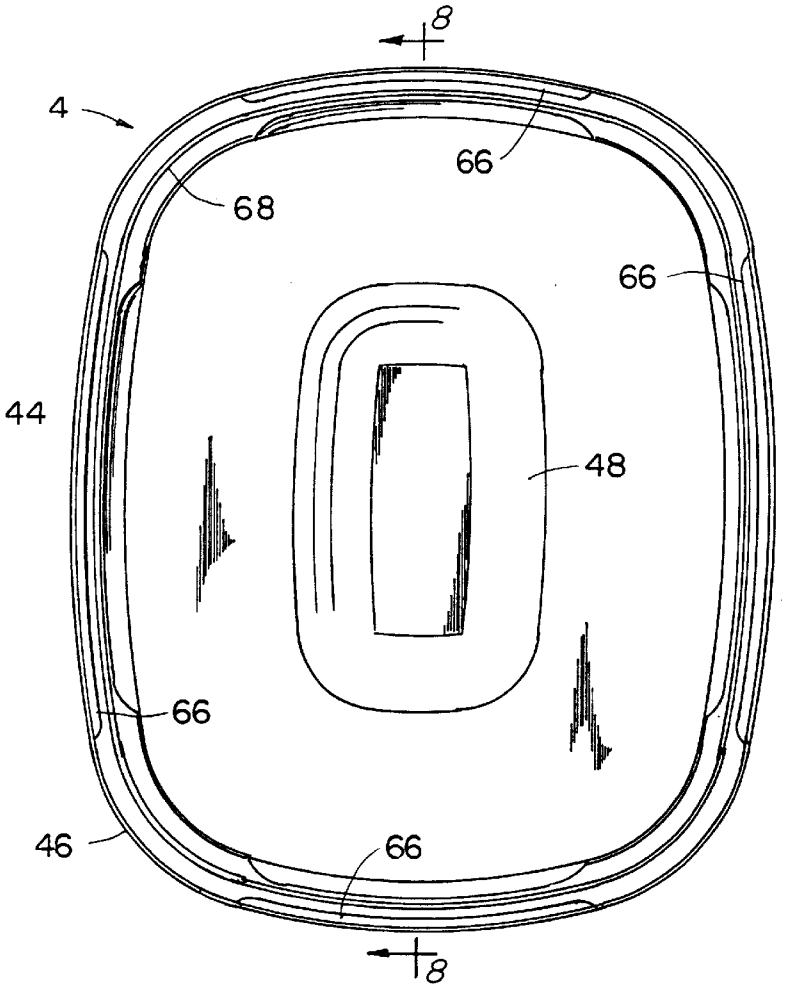
FIGS. 6 and 7 are plan and bottom views of the lid shown in FIG. 1.
Figure 6:
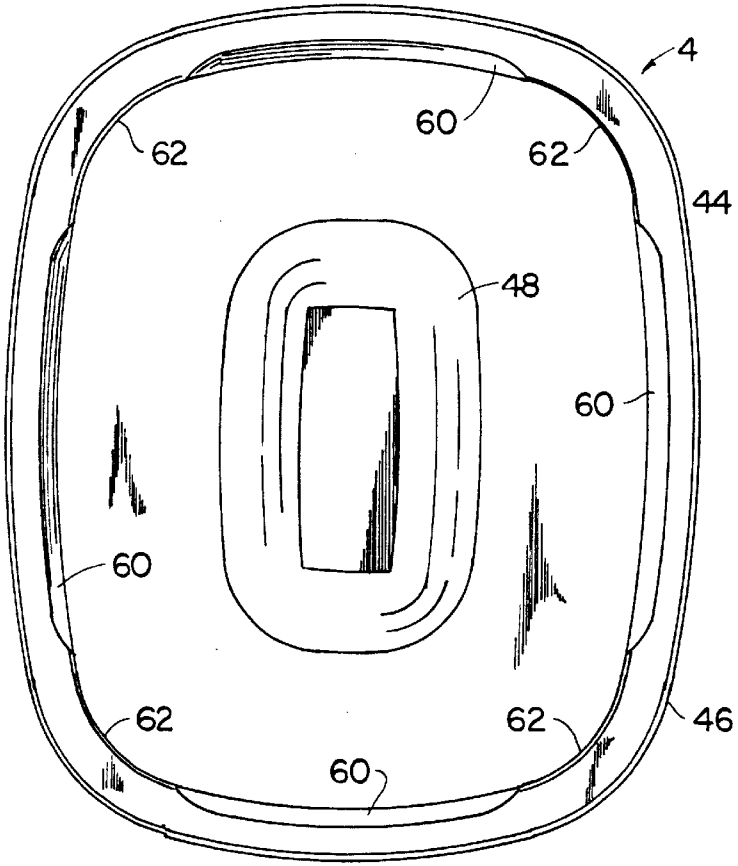

Turning now to FIGS. 1, 2 and 5, it is to be noted that the bottom wall of the container and the bottom ends of the side walls are contoured so as to form a plurality of spaced feet 24 and a plurality of openings 26 between the adjacent feet. Inwardly of feet 24, the bottom wall 12 is formed with a continuous section 28 that is slanted inwardly and upwardly and joins a center section 30. As a consequence, inwardly of feet 24 substantially all of bottom wall 12 is raised above the level of top edges of openings 26. Additionally, but not necessarily, the central portion of the bottom wall may have a further raised or domed portion 32 and a downwardly projecting circular ring 34 on its bottom surface. The domed portion 32 and ring 34 are merely for strengthening purposes and may be omitted.

It is to be noted that the thickness of the bottom wall is essentially the same throughout its length and breadth, the feet 24 being formed by contouring that wall, with the result that on the inside of the container depressions 38 are formed on the upper side of the bottom wall at the location of each of the feet 24. The number and spacing of the feet 24 and the width and height of the spaces or openings 26 is a matter of choice, but the openings 26 must be at least wide enough and high enough to permit flow of air between adjacent containers that are stacked one on top of the other, as explained hereinafter.

Turning now to FIGS. 1, 2 and 6–9, the lid 4 is formed with a crown 44 and a rim 46. The crown 44 may be flat throughout its length and breadth or it may be contoured. In the illustrated embodiment, the crown is contoured so as to form a raised section in the shape of a generally rectangular ring 48 for strengthening purposes and also for aesthetic value. As seen best in FIGS. 8–10, the rim has a generally U-shaped cross-sectional configuration, comprising an upturned inner wall portion 50, an intermediate and top wall portion 52 and a depending outer wall portion 54 that forms a depending skirt for the rim. The crown 44 is recessed in the sense that the rim portions 50, 52 and 54 all project above it. It should be noted also that the dimensions and configuration of the inner edge 58 (FIG. 9) of the inner wall portion 50 are such as to provide a close fit between that inner edge and the bottom end of a container (as described above) that is resting on the lid. The inner wall portion 50 is formed with four depressions 60, one at each side of the lid, to facilitate flow of frigid air or other freezing gas between the lid and the bottom end of a container supported on the lid. Depressions 60 are sized so that when the lid is secured to the top of the container, the depressions will be in radial alignment with at least portions of the openings 26. The depression-free corner sections 62 of inner wall portion 50 serve as restraints for preventing lateral shifting of a container that is resting on the top side of the lid.

Figure 8:
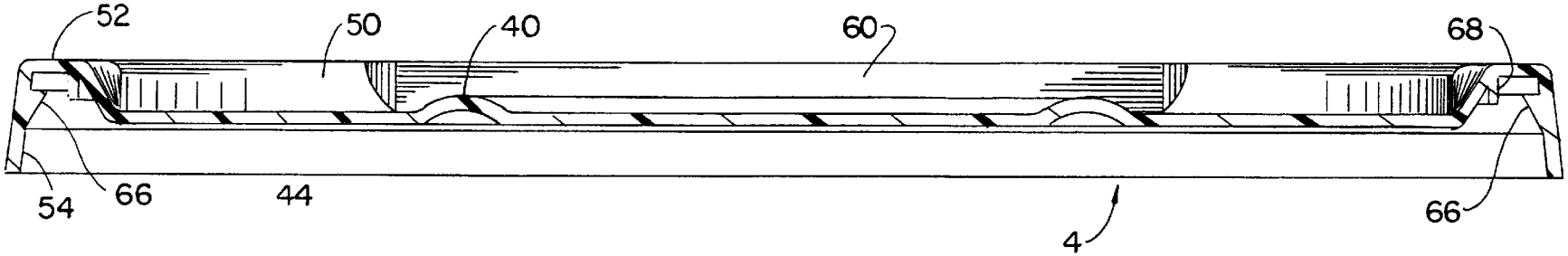
FIG. 8 is a cross-sectional view taken along line 8—8 respectively of FIG. 7.
Figure 9:
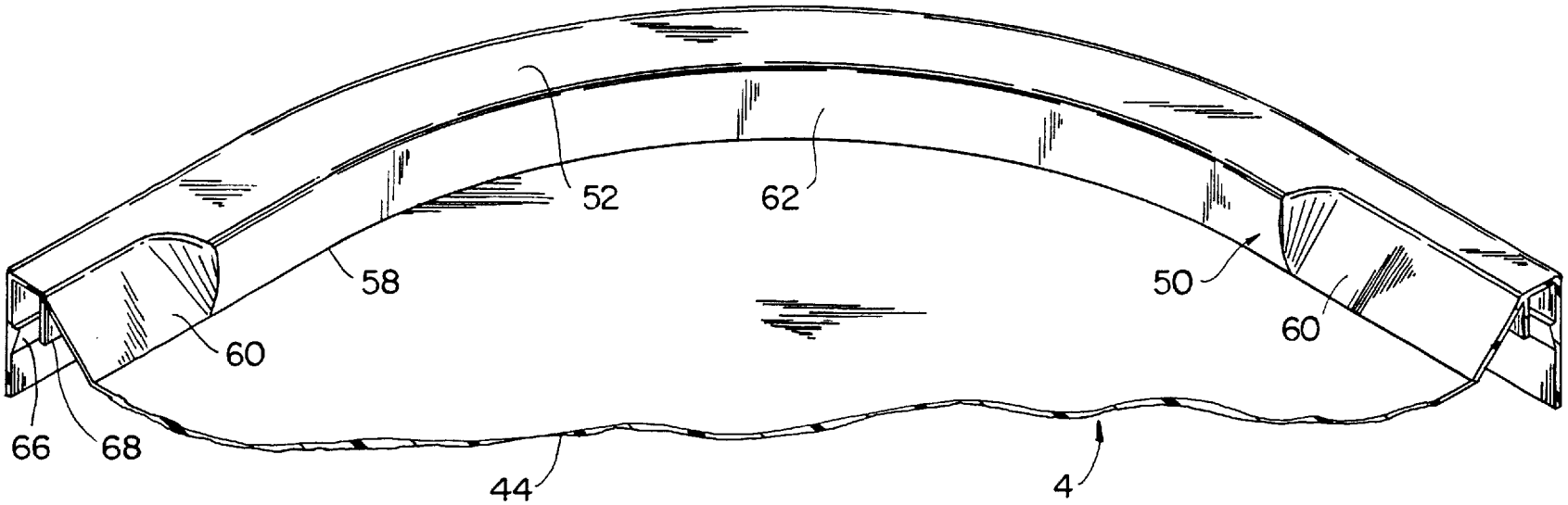
FIG. 9 is a fragmentary perspective view of the same lid.

It is to be noted that the thickness of the several wall portions of the rim are substantially the same throughout their length and breadth, except for certain hereinafter described features on its inner side. Turning now to FIGS. 4, 8 and 9, the inner edge of the outer skirt portion 54 is provided with means for releasably connecting the lid to the container. Such connecting means take the form of four inwardly projecting locking ribs 66 formed on the inner side of outer wall portion 54. Ribs 66 are shaped and sized to make a snap connection with peripheral flange 14 of container 2. If desired, ribs 66 could be replaced by one continuous locking rib. Preferably the ribs 66 have a triangular cross-sectional shape as shown in FIGS. 8 and 9, since the inclined inner surface of the ribs makes it easy to attach the lid to the container by a snap-action, while the flat annular upper surface of the ribs assures a secure connection to flange 14.

Still referring to FIGS. 4, 8 and 9, the lid also has a depending ring or flange 68 that follows the general peripheral contour of the lid. Flange 68 is formed substantially at the junction of the inner surfaces of rim wall portions 50 and 52. Flange 68 is sized so that it can extend down inside of the container (see FIG. 10) and make a relatively close fit with the inner surfaces of side walls 8A, 8B and 10A, 10B, thereby confining the upper end of the container between it and outer wall section 54, with peripheral flange 14 interlocked with ribs 66. This concentric arrangement of ring 68, the side wall of the container and outer wall section 54 assures that when a filled container is placed on and supported by the lid, as illustrated in FIG. 10, the force exerted by the supported container 4B will not deform the lid to the extent that would affect the security of its interlocking connection with the container 4A.

Referring now to FIGS. 8–10, when several containers (2A–2C) are stacked one upon the other so that lids 4A and 4B support containers 4B and 4C, the inner wall portions 50 of lids 4A and 4B restrain containers 4B and 4C against shifting laterally in any direction. More importantly, the depressions 60 of inner wall portions 50 of lids 4A and 4B are located and sized so as to be radially spaced from but in radial registration with openings 26 for all or most of the latter's circumferential expanse, whereby depressions 60 and openings 26 provide multiple passageways through which product-freezing gas can flow between the containers. Since openings 26 and depressions 60 are distributed around the peripheries of the stacked closed containers, product-freezing gas can flow fully through the space between the stacked containers, thereby assuring quick freezing of the contents at the top and bottom of the containers. Having a major portion of the container bottom wall 12 raised as shown in FIGS. 5 and 8 also is advantageous in that it maximizes the volume of freezing gas that can be present between stacked closed containers at any given time, thereby providing an increased heat-absorbing capacity between the containers which in turn assists in achieving quick and uniform freezing. In the absence of the passages provided by openings 26 and depressions 60, the freezing would tend not to be uniform from the container top to the container bottom.

In addition to facilitating quick freezing of the contents of stacked containers, the invention offers the advantage that containers and lids constructed as herein described can be made of relatively low cost and relatively strong materials, e.g., high density polyethylene. Another advantage is that the containers and lids can be manufactured using conventional plastic molding apparatus. A further advantage is that the containers and lids can be used to quick freeze other comestibles besides fruit. Still other advantages will be obvious to persons skilled in the art.

Obviously the invention may be practiced otherwise than as specifically illustrated and described. Thus, for example, the container may be modified by changing the number of feet 24 and the width and height of the openings 26. Corresponding changes also may be made in the lid, e.g., increasing or decreasing the number of depressions 60 in the lid. Also, the angle at which the inner wall portion 50 extends relative to the upper portion 52 of the rim may be modified. It is also contemplated that the invention may be modified to provide for attachment of the lids to the containers by a bayonet or screw connection, the sole requirement being that the lids be disposed so that when one container is stacked upon another, the depressions 60 of the container-supporting lid be aligned with the gaps or spaces 26 between the feet 24 of the bottom end of the supported container, so as to assure that passageways exist through which freezing gas can flow. Still other modifications will be obvious to persons skilled in the art.

What is claimed is:

1. A container and lid combination for use in freezing and storing fruit or other food comprising:

a plastic container comprising a side wall having a top end and a bottom end, and a bottom wall formed integral with said bottom end of said side wall, said side wall having an outwardly protruding flange at said top end thereof for interlocking with a covering lid for the container, said bottom wall and said side wall being formed so as to define a plurality of feet that protrude below said bottom wall, with said feet being mutually spaced around said bottom wall so as to define openings therebetween; and a plastic lid for covering and closing off said container, said lid comprising a crown and a rim formed integral with and surrounding said crown, said rim comprising an inner wall, an outer wall concentric with said inner wall and forming a skirt, and an intermediate wall disposed between and connecting said inner and outer walls, with said crown having a top surface and a bottom surface and said intermediate wall projecting above said top surface and said outer wall extending below said bottom surface, said outer wall having locking means for interconnecting with said flange so as to secure said lid to said container in covering relation to the interior space of said container, said inner wall of said rim having mutually spaced depressions distributed along its length that are aligned with at least some of said openings when said lid is secured to said container by interconnection of said flange and said locking means, said intermediate wall of said rim having a reduced width at each of said depressions.

2. A combination according to claim 1 wherein said depressions are formed in part by portions of said inner wall of said rim that are slanted upwardly and outwardly from said rim.

3. A combination according to claim 2 wherein said lid has a generally rectangular configuration, and said inner wall has corner portions that are shaped to act as lateral restraints for the feet of a like container that are resting on said top surface of said crown, whereby to prevent lateral shifting of said like container relative to said lid.

4. The combination of first and second container and lid assemblies adapted for stacking one upon the other, each of said container and lid assemblies comprising a plastic container formed with an open top end and a closed bottom end, and a plastic lid for closing off said open top end of said container, each of said plastic containers having peripheral means at its top end for interlocking with said lid and a plurality of feet at its closed bottom end, said feet being spaced apart from one another around the perimeter of said container so as to define openings between them; and each of said plastic lids comprising a crown and a rim formed integral with and surrounding said crown, said rim comprising an inner wall section, an outer wall section concentric with said inner wall section and forming a skirt, and an intermediate wall section disposed between and connecting the upper ends of said inner and outer wall sections, with said crown being recessed below said intermediate wall section and said outer wall section extending below said crown, a plurality of depressions formed in said inner wall section, means on the inside of said outer wall section for interlocking with said peripheral means so as to lock said lid to said container, said inner wall section having an inner edge configuration that has substantially the same shape as but is slightly larger than the bottom end of said container, whereby said second container and lid assembly can be positioned with its bottom end resting on the lid of said first container and lid assembly, with its said bottom end nested inside of the inner wall section of said lid of said first container and lid assembly, whereby said depressions of said lid of said first container and lid assembly and the openings between the feet of the container of said second container and lid assembly cooperate to provide passageways whereby a freezing gas can flow between the lid of said first container and lid assembly and the bottom end of the container of said second container and lid assembly.

5. The combination of claim 4 wherein said container and said lid have a substantially rectangular configuration.

6. The combination of claim 5 wherein said lid has four of said depressions and said container has eight of said openings.

7. A container and lid combination for use in freezing and storing fruit or other food comprising:

a plastic container comprising a side wall having a top end and a bottom end, and a bottom wall formed integral with said bottom end of said side wall, said side wall having an outwardly protruding flange at said top end thereof for interlocking with a covering lid for the container, said bottom wall and said side wall being formed so as to define a plurality of feet that protrude below said bottom wall, with said feet being mutually spaced around said bottom wall so as to define openings therebetween, first and second diametrically opposed handle supports molded in place on portions of said side wall of said container, said first and second handle supports each including an auxiliary side wall that is spaced from said portions of said side wall of said container, and an opening in each of said auxiliary side walls for pivotally accommodating the ends of a handle for lifting and carrying said container; and a plastic lid for covering and closing off said container, said lid comprising a crown and a rim formed integral with and surrounding said crown, said rim comprising an inner wall section, an outer wall section concentric with said inner wall section and forming a skirt, and an intermediate wall section disposed between and connecting said inner and outer wall sections, with said crown having a top surface and a bottom surface and said intermediate wall section projecting above said top surface and said outer wall section extending below said bottom surface, said outer wall section having locking means for interconnecting with said flange so as to secure said lid to said container in covering relation to the interior space of said container, said inner wall section of said rim having mutually spaced depressions distributed along its length that are aligned with at least some of said openings when said lid is secured to said container by interconnection of said flange and said locking means.

8. A container and lid combination for use in freezing and storing fruit or other food comprising:

a plastic container comprising a side wall having a top end and a bottom end, and a bottom wall formed integral with said bottom end of said side wall, said side wall having an outwardly protruding flange at said top end thereof for interlocking with a covering lid for the container, said bottom wall and said side wall being formed so as to define a plurality of feet that protrude below said bottom wall, with said feet being mutually spaced around said bottom wall so as to define openings therebetween; and a plastic lid for covering and closing off said container, said lid comprising a crown and a rim formed integral with and surrounding said crown, said rim comprising an inner wall section, an outer wall concentric with said inner wall section and forming a skirt, and an intermediate wall section disposed between and connecting said inner and outer wall sections, with said crown having a top surface and a bottom surface and said intermediate wall section projecting above said top surface and said outer wall section extending below said bottom surface, said outer wall section having locking means for interconnecting with said flange so as to secure said lid to said container in covering relation to the interior space of said container, said inner wall section of said rim having mutually spaced depressions distributed along its length that are aligned with at least some of said openings when said lid is secured to said container by interconnection of said flange and said locking means, said inner wall section of said rim having an inner edge configuration that has substantially the same shape but is slightly larger than the footprint of the bottom end of said container, whereby another like container can be positioned on said lid with its bottom end nested inside of the inner wall section of said rim.

* * * * *